US008330032B1

(12) United States Patent
Sikra

(10) Patent No.: US 8,330,032 B1
(45) Date of Patent: Dec. 11, 2012

(54) PIVOT SUPPORTS FOR DRUM RIM

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 82 days.

(21) Appl. No.: 12/925,423

(22) Filed: Oct. 22, 2010

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS

| | | | | | |
|---|---|---|---|---|---|
| 1,042,919 | A | * | 10/1912 | Hughes | 84/422.2 |
| 2,446,508 | A | * | 8/1948 | Crowell | 84/422.1 |
| 3,055,254 | A | * | 9/1962 | Haviland | 84/422.1 |
| 3,316,792 | A | * | 5/1967 | Ippolito | 84/422.1 |
| 3,426,640 | A | * | 2/1969 | Slingerland, Jr. | 84/422.1 |
| 3,722,349 | A | * | 3/1973 | Hoellerich | 84/422.1 |
| 5,185,489 | A | * | 2/1993 | Hoshino | 84/422.1 |
| 5,317,946 | A | * | 6/1994 | Hoshino | 84/422.1 |
| 5,627,332 | A | | 5/1997 | Lombardi | |
| 5,726,370 | A | * | 3/1998 | Yanagisawa | 84/422.1 |
| D402,683 | S | * | 12/1998 | Brewster et al. | D17/22 |
| 6,011,208 | A | * | 1/2000 | Hoshino | 84/422.1 |
| 6,147,288 | A | * | 11/2000 | Liao | 84/422.1 |
| 6,166,312 | A | * | 12/2000 | Brewster et al. | 84/422.1 |
| 6,538,184 | B2 | * | 3/2003 | Hsieh | 84/422.1 |
| 6,596,934 | B2 | * | 7/2003 | Hsieh | 84/422.1 |
| 6,632,990 | B2 | * | 10/2003 | Menzel et al. | 84/422.1 |
| 6,992,244 | B2 | * | 1/2006 | Paul et al. | 84/422.1 |
| 7,381,877 | B2 | * | 6/2008 | Shigenaga | 84/422.1 |
| 7,812,237 | B1 | * | 10/2010 | Dunnett | 84/422.1 |
| 7,897,858 | B1 | * | 3/2011 | Liao | 84/422.1 |
| 2007/0169611 | A1 | * | 7/2007 | Chen | 84/422.1 |

* cited by examiner

*Primary Examiner* — David Warren
*Assistant Examiner* — Robert W Horn
(74) *Attorney, Agent, or Firm* — William W. Haefliger

(57) ABSTRACT

In a drum beating assembly, the combination comprising a frame, including at least one pedestal, an axle carried by the pedestal to rotate relative thereto, the axle having an axis of rotation, a drum beater carried by the axle, a pedal operatively connected to the axle to rotate the axle and beater in response to pedal movement, the frame including a base plate, there being a clamp arm and means supporting the arm on the plate to pivot relative thereto, and multiple drum rim support elements carried to engage the drum rim at multiple locations to support the drum rim relative to the base plate. The support elements are typically pivotable to self-adjust during clamp up.

25 Claims, 5 Drawing Sheets

PIVOT SUPPORTS FOR DRUM RIM

BACKGROUND OF THE INVENTION

This invention relates generally to drum beating apparatus connectable to drums, such a bass drum rims, and more particularly concerns stabilized connection of beater base plates to bass drum rims.

There is need for stabilization of such connections, and particularly prevention of disconnection during drum beating. This is a problem due to relatively heavy sizes and weights of bass drums to be and remain accurately connected to drum beaters over extended use periods. There is also need for the particularly efficient and reliable connection modes and apparatus as enabled and provided by the present invention.

SUMMARY OF THE INVENTION

It is a major object of the invention to provide improved apparatus meeting the above needs as well as other needs and objectives. Basically, the invention is embodied in the combination that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate.

As will be seen, at least one, and typically at least two of such elements are provided to be pivotally self adjusting during engagement of the elements with a drum rim. Further, there are preferably three of such support elements at least one of which is or are pivotally self adjustable and located to engage the convex side of a drum rim that has both convex and concave sides.

Further self-adjustment is enhanced and facilitated as by toggle support of one or more of the elements, enabling universal directional pivoting, during clamp-up.

Another object includes provision of a carrier, such as a plate, connectible to the base plate, the carrier carrying at least two of said elements, that are engagable with the convex side of a drum rim. A third of the elements may then be carried by the arm, to engage the concave side of the drum rim, in response to arm pivoting relative to the base plate.

As will be seen, and for enhanced, and balanced clamping force distribution, the third element is typically located in a plane substantially normal to an axis passing through said two elements.

A further object is to provide an assembly that comprises:

a) a frame, including at least one pedestal, b) an axle carried by the pedestal to rotate relative thereto, the axle having an axis of rotation, c) a drum beater carried by the axle, d) a pedal carried by the frame to rotate the beater about said axis in response to pedal movement, e) drum clamping means carried by the frame, and having separate clamping surfaces at least two of which are each supported to pivot in multiple directions, said surfaces engageable with curved drum structure.

These and other objects and advantages of the invention, as well as the details of an illustrative embodiment, will be more fully understood from the following specification and drawings, in which:

DRAWING DESCRIPTION

DETAILED DESCRIPTION

Figure 1:
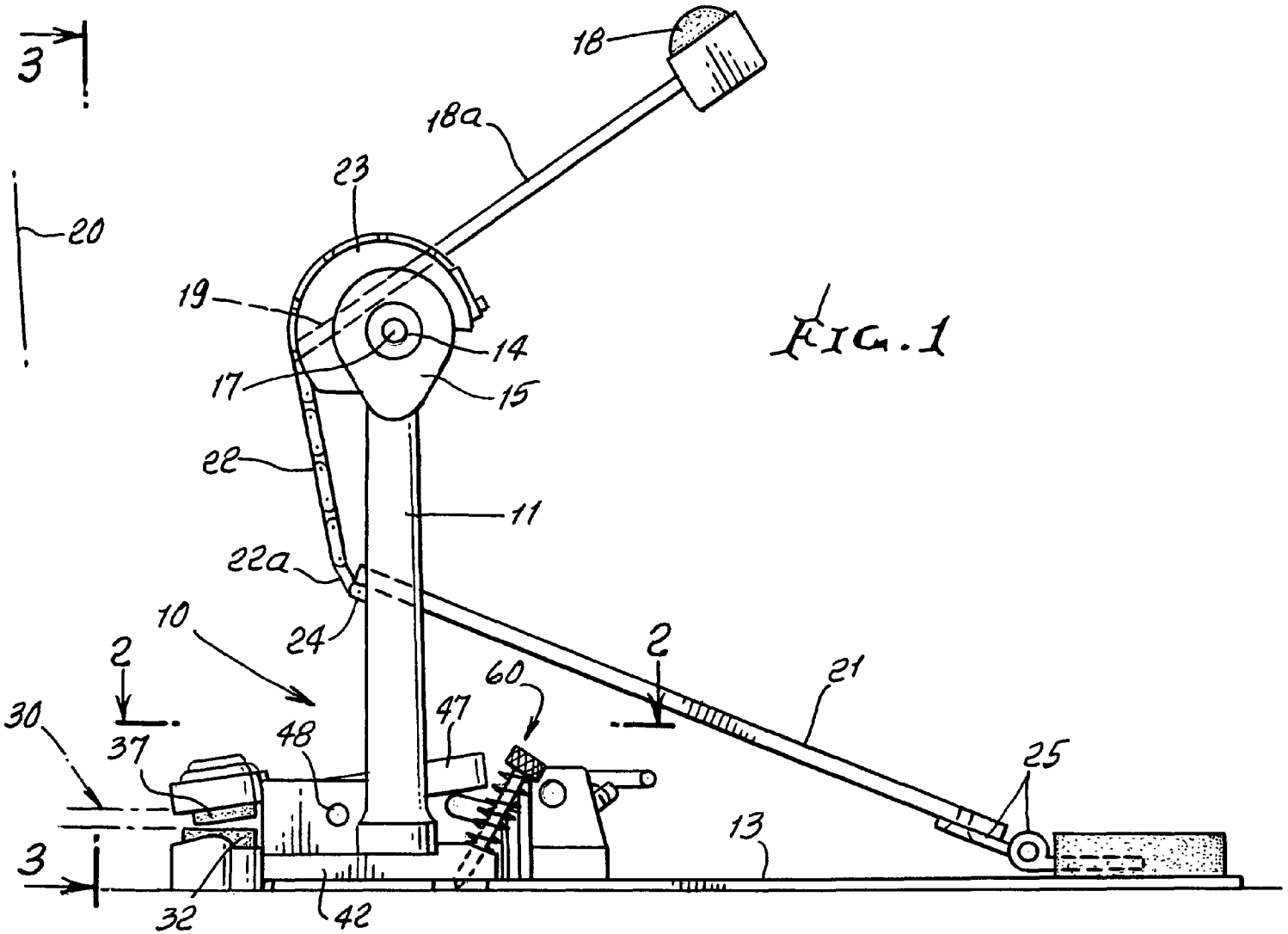
FIG. 1 is a side elevation view of drum beater apparatus incorporating the invention.

In the drawings, the drum beating assembly 10 includes a frame having a least one, and preferably two upright pedestals 11 and 12 mounted on the horizontal base plate 13. An axle 14 is carried by the pedestals, as via suitable bearings in housings 15 and 16, the axle having a horizontal axis 17 of rotation. A drum beater 18 has a stem 18*a* carried by the axle at 19 to be rotated forwardly to strike a head, indicated at 20.

A foot pedal 21 is operatively connected to the axle, as via a chain 22 engaging a sprocket 23, the end 22*a* of the chain being connected at 24 to the forward end of the pedal 21. The rearward end of the pedal is pivotally connected at 25 to the base plate 13.

Figure 7:
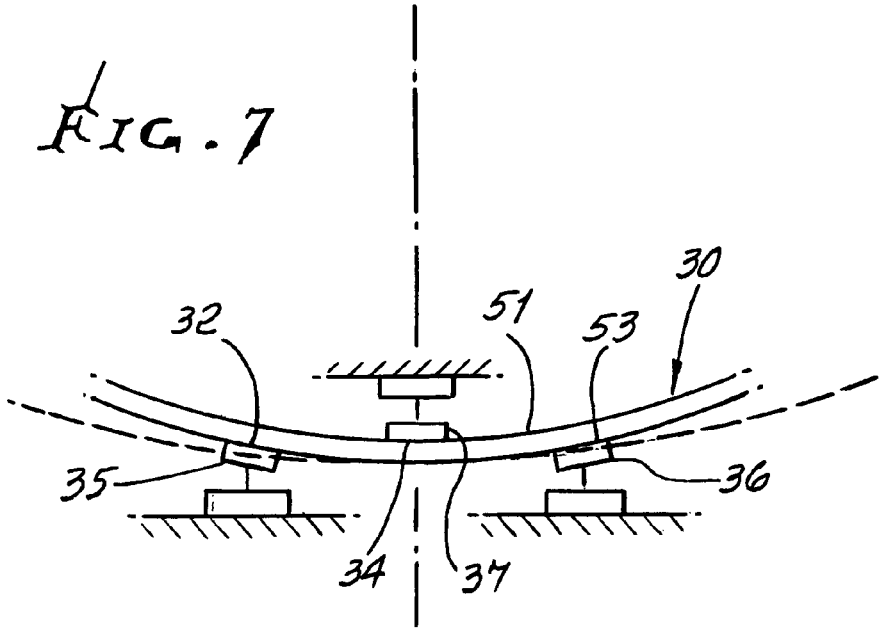
FIG. 7 is a schematic front elevation view showing elements engagable with a curved drum rim for adjustable clamping.

In accordance with an important aspect of the invention, and arcuate bass drum rim 30 is positioned to be self adjustably clamp connected to the base plate, as for example via connections schematically shown by structures indicated in FIG. 7. Such structures include multiple drum rim support elements carried to engage the drum rim at multiple locations, as for example are indicated at 32-34, to support the drum rim relative to the base plate. The corresponding elements are shown at 35-37, elements 35 and 36 engaging the convex outer side of the rim, and element 37 engaging the concave inner side of the rim. The rim engaged sides of such elements may have slight curvature to match rim curvature.

Figure 8:
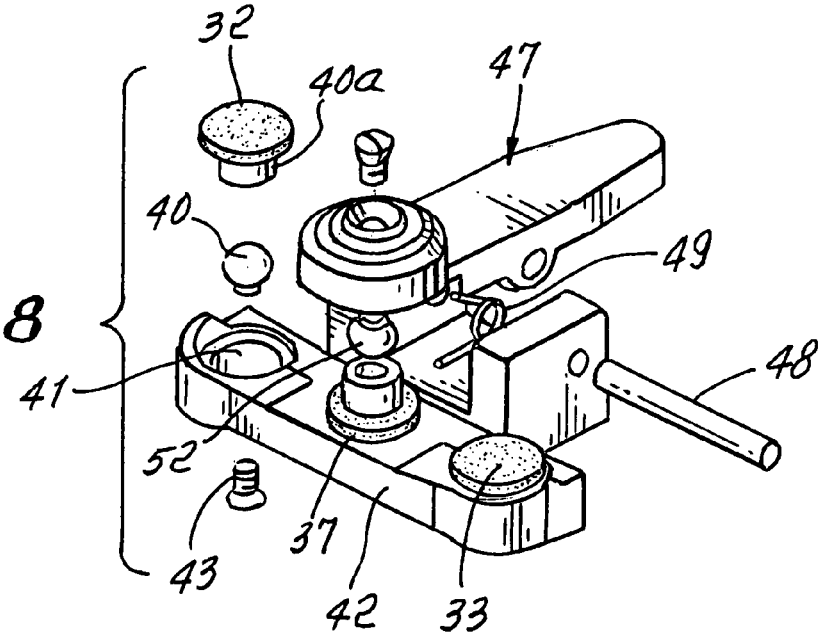
FIG. 8 showing a preferred form, is an exploded view showing elements of drum rim clamping mechanism separate from, but attachable to beater apparatus.

FIG. 8 shows actual such elements in the form of two swiveling caps, corresponding to FIG. 7 elements 32 and 33, having sockets 40*a* that embrace balls 40 received in recesses 41 in a carrier plate 42, part of the sub-assembly as shown. Plate 42 is attached or attachable as by fasteners 42*a'* to the base plate. Balls 40 are also attached to the plate 42 as by fasteners 43. See FIG. 4. Sockets 40*a* swivel in sockets 42*b*. A third swiveling cap corresponds to element 37 and is carried by the clamp arm 47, pivoted at pin 48, and urged by spring 49 in a counterclockwise direction in FIG. 8 to urge cap 37 downwardly against the drum inner concave surface 51. Cap 50 is carried by a swiveling socket 51 that receives ball 52. The balls and swiveling sockets and caps define toggle connections, that self-adjust to conform to the particular drum rim being retained. The sub-assembly shown in FIG. 8 is well adapted to attach to an existing pedal unit, as on a base plate 13, to enable its efficient use to firmly support a bass drum, as during beating use.

Further adjustments as respects connection of the sub-assembly to a support plate, are shown at 60 in FIG. 1. See in this regard U.S. Pat. No. 5,627,332, incorporated herein by reference.

Figure 4:
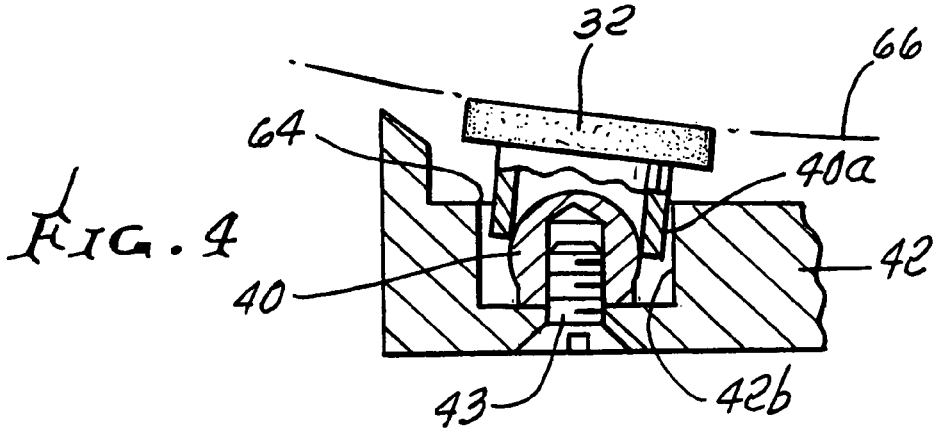
FIG. 4 is a fragmentary section taken on lines 4-4 of FIG. 2.

FIG. 4 shows reception of a socket 40*a* in a recess or socket 42*b* in the clamp plate 42 to swivel relative to the fixed position ball 40. Recess or socket annular edge 64 is engagable by the socket 40*a* outer wall to limit swiveling of the cap 32, blocking extreme swiveling and thereby maintaining the cap oriented generally toward the drum rim indicated by curved line 66, minimizing need for self-adjustment swiveling for assembly and ease of use purposes.

The invention is further characterized by:

multiple drum rim support elements carried to engage the drum rim at multiple locations to support the drum rim relative to the base plate;

at least one of said elements being pivotally self-adjustable during engagement of said elements with the drum rim;

at least two of such elements being pivotally adjustable during engagement of said elements with the drum rim;

at least three of said elements are pivotally adjustable during engagement of said elements with the drum rim;

two of such elements are located to engage the convex side of a drum rim that has both convex and concave sides;

a third of said elements is located to engage the concave side of the drum rim the elements being selectively toggle supported;

a carrier or plate (part of a sub-assembly) connectable to said base plate, the carrier carrying at least two of said elements, that are engagable with the convex side of a drum rim;

the third element carried by the clasp arm to engage the concave side of the drum rim, in response to arm pivoting relative to the base plate.

Figure 2:
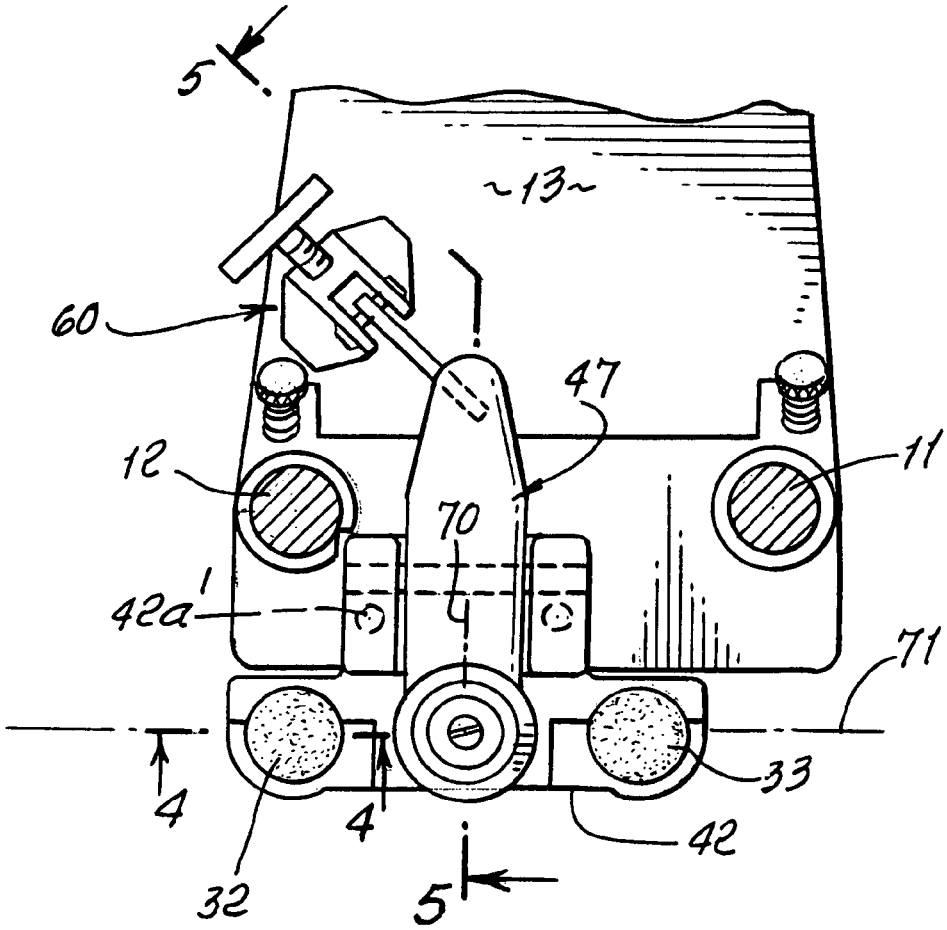
FIG. 2 is a plan view taken on lines 2-2 of FIG. 1.
Figure 3:
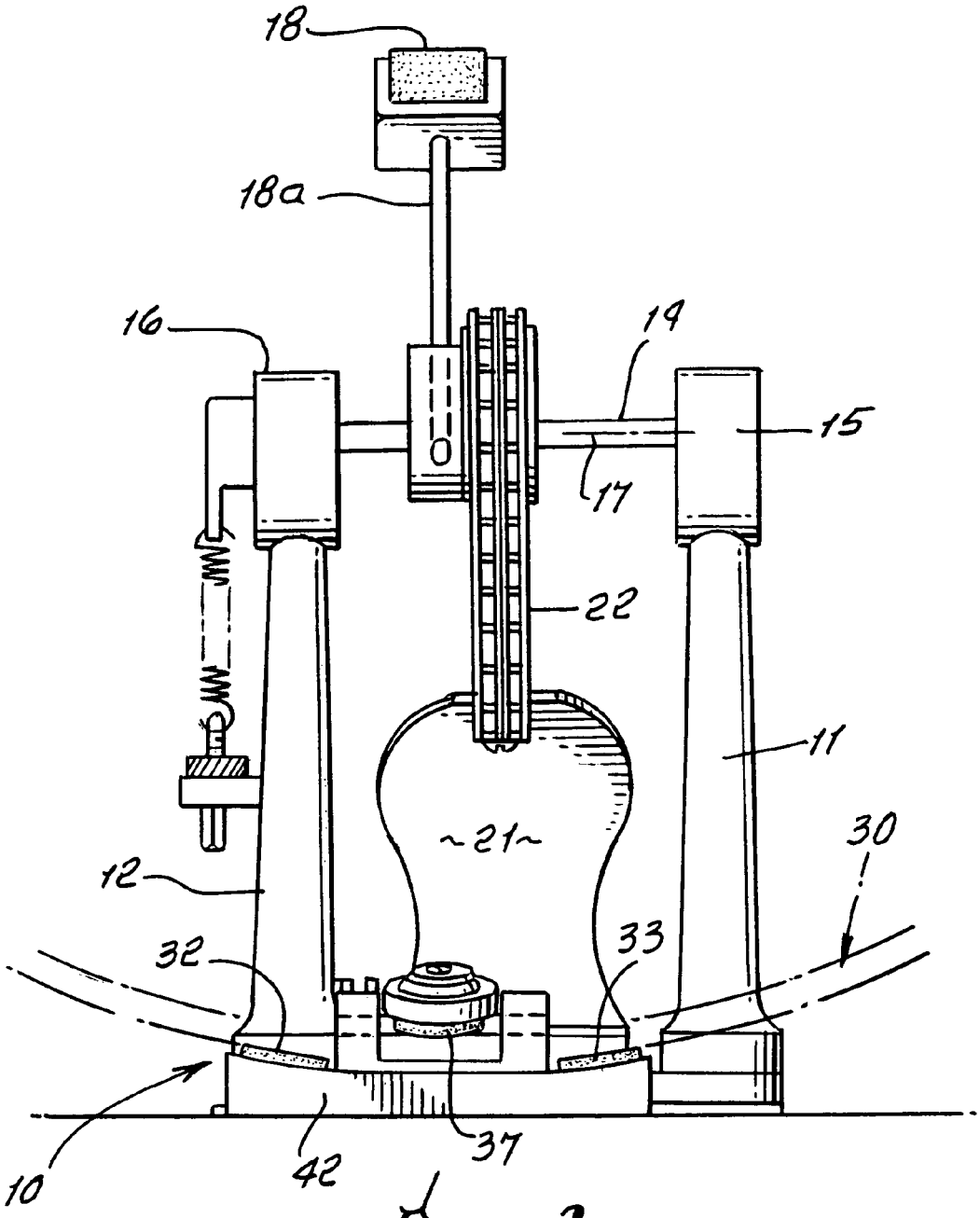
FIG. 3 is a front elevation view taken on lines 3-3 of FIG. 1.
Figure 5:
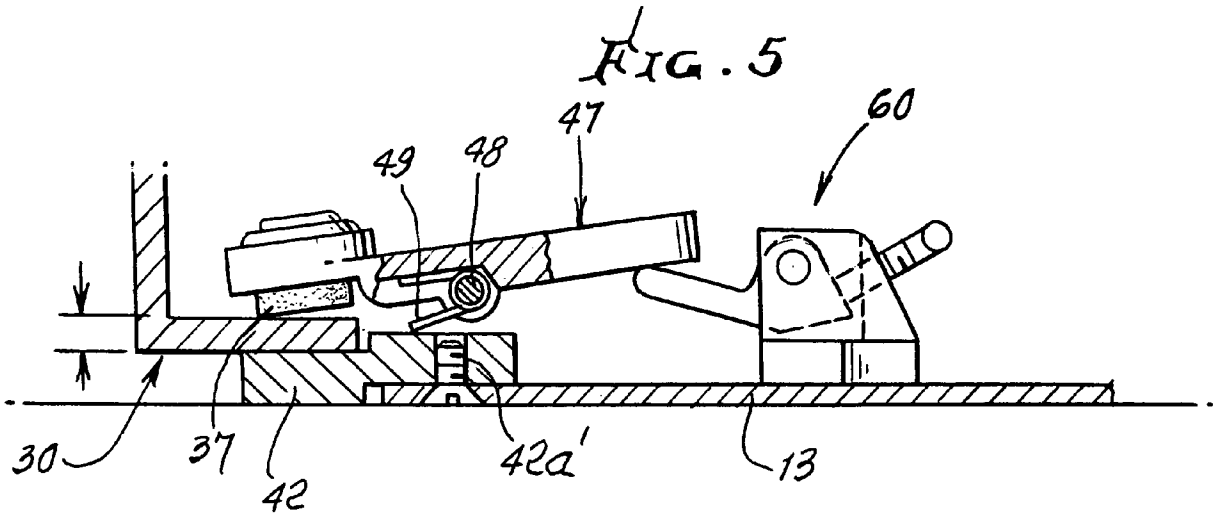
FIG. 5 is a section taken on lines 5-5 of FIG. 2.
Figure 6:
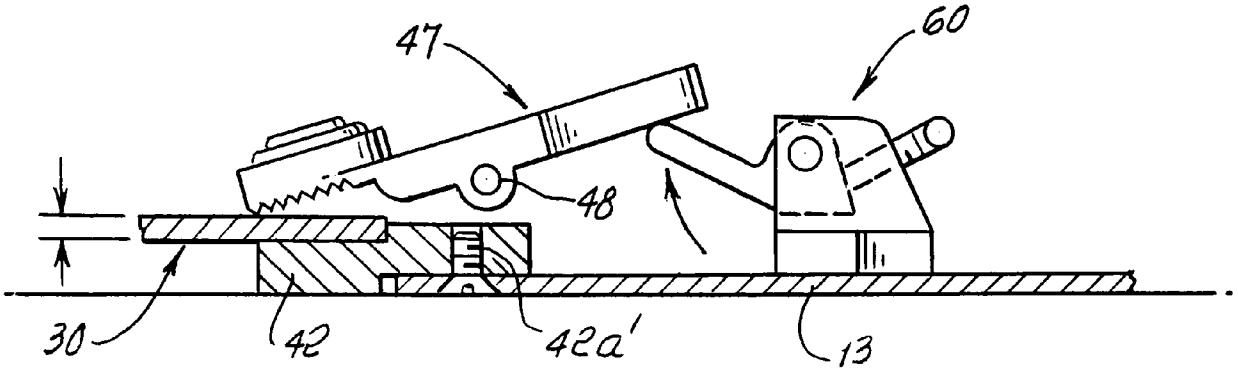
FIG. 6 is a view like FIG. 5, but showing a modification.

It will be noted in FIG. 2 that the third element or cap 37 is located in an upright plane 70 substantially normal to an axis 71 passing through the two elements 32 and 33.

What is claimed is:

1. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) at least two of said elements being rotatably adjustable during engagement of said two elements with the drum rim.

2. The combination of claim 1 wherein at least one of said elements is pivotally self-adjustable during engagement of said elements with the drum rim.

3. The combination of claim 1 including a carrier connectable to said base plate, the carrier carrying at least two of said elements, that are engagable with the convex side of a drum rim.

4. The combination of claim 3 wherein a third of said elements is carried by said arm to engage the concave side of the drum rim, in response to arm pivoting relative to the base plate.

5. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) and wherein at least two of said elements are pivotally adjustable during engagement of said elements with the drum rim.

6. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) and wherein at least three of said elements are pivotally adjustable during engagement of said elements with the drum rim.

7. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) and wherein there are three of said support elements at least two of which are pivotally self adjustable and are located to engage the convex side of a drum rim that has both convex and concave sides.

8. The combination of claim 7 wherein a third of said elements is pivotably self adjustable, and located to engage the concave side of the drum rim.

9. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) at least one of said elements is pivotally self-adjustable during engagement of said elements with the drum rim, h) and wherein said one element has a toggle support.

10. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) and multiple drum rim support elements carried to engage the drum rim at multiple locations to support the drum rim relative to the base plate, g) at least two of said elements are pivotally adjustable during engagement of said elements with the drum rim.

h) and wherein each of said two elements has toggle support.

11. The combination of claim 10 and wherein there is a third of said elements pivotally self adjustable, and located to engage the concave side of the drum rim.

12. The combination of claim 11 wherein said third element is carried by said clamp arm.

13. The combination of claim 12 including a carrier plate carrying said two elements, and connectible to the base plate.

14. The combination of claim 12 wherein said third element is located in a plane substantially normal to an axis passing through said two elements.

15. For use with a drum beating assembly, that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) a carrier connectible to the base plate, g) and multiple drum rim support elements carried by the carrier to engage the drum rim at multiple locations, thereby to support the drum rim relative to the base plate, in response to pivoting of said clamp arm, h) and wherein at least two of said elements are pivotally adjustable during engagement of said elements with the drum rim.

16. The combination of claim 15 wherein at least three of said elements are pivotally adjustable during engagement of said elements with the drum rim.

17. The combination of claim 15 wherein there are three of said support elements at least two of which are pivotally self adjustable and are located to engage the convex side of a drum rim that has both convex and concave sides.

18. The combination of claim 17 wherein there is a third of said elements pivotably self adjustable, and located to engage the concave side of the drum rim.

19. For use with a drum beating assembly, that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) a carrier connectible to the base plate, g) and multiple drum rim support elements carried by the carrier to engage the drum rim at multiple locations, thereby to support the drum rim relative to the base plate, in response to pivoting of said clamp arm, h) and wherein at least one of said elements is pivotally self-adjustable during engagement of said elements with the drum rim, i) and wherein said one element has a toggle support.

20. For use with a drum beating assembly, that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm and means supporting the arm on the plate to pivot relative thereto, f) a carrier connectible to the base plate, g) and multiple drum rim support elements carried by the carrier to engage the drum rim at multiple locations, thereby to support the drum rim relative to the base plate, in response to pivoting of said clamp arm, h) and wherein at least one of said elements is pivotally self-adjustable during engagement of said elements with the drum rim, i) and wherein each of said two elements has toggle support.

21. In a drum beating assembly, the combination comprising a) a frame, including at least one pedestal, b) an axle carried by the pedestal to rotate relative thereto, the axle having an axis of rotation, c) a drum beater carried by the axle, d) a pedal carried by the frame to rotate the beater about said axis in response to pedal movement, e) drum clamping means carried by the frame, and having separate clamping surfaces at least two of which are each supported to pivot in multiple directions, said surfaces engageable with curved drum surfaces, f) at least two of said clamping surfaces being pivotally adjustable during engagement of said elements with the drum rim.

22. The combination of claim 21 in which there are three of said clamping surfaces engageable with curved drum surface structure.

23. The combination of claim 22 in which said two clamping surfaces are spaced apart to adjustably engage one side of said curved drum structure.

24. The combination of claim 23 in which the third clamping surface is offset from said two clamping surfaces to engage an opposite side of said curved drum structure.

25. The combination of claim 24 in which said third clamping surface is also supported to pivot in multiple directions in response to its engagement with the drum structure opposite sides.

* * * * *